US005732753A

United States Patent [19]

Danzi et al.

[11] Patent Number: 5,732,753

[45] Date of Patent: Mar. 31, 1998

[54] CONCRETE WALL FORM ALIGNING FUNNEL SYSTEM

[76] Inventors: Robert Danzi; Anthony Danzi, both of 318 Forbush Ave., Boonton, N.J. 07005

[21] Appl. No.: 775,730

[22] Filed: Dec. 31, 1996

[51] Int. Cl.[6] ..... B65B 39/00; B67C 11/04

[52] U.S. Cl. ..... 141/340; 141/331; 52/749.13; 52/DIG. 1; 52/742.14

[58] Field of Search ..... 52/742.1, 742.13, 52/742.14, DIG. 1, 749.13, 749.1; 141/331, 34

[56] References Cited

U.S. PATENT DOCUMENTS

| | | | |
|---|---|---|---|
| 4,007,821 | 2/1977 | Schiffelbein | 193/4 |
| 4,190,144 | 2/1980 | Lybbery | 193/10 |
| 4,409,764 | 10/1983 | Wilnov | 52/742.14 X |
| 4,572,782 | 2/1986 | Smith et al. | 209/236 |
| 4,634,285 | 1/1987 | Newberry | 366/68 |
| 4,756,033 | 7/1988 | Schelthorst | 52/169.7 X |
| 5,445,196 | 8/1995 | Tyree, Jr. | 141/331 X |
| 5,458,169 | 10/1995 | Biofore | 141/331 X |

*Primary Examiner*—Carl D. Friedman
*Assistant Examiner*—W. Glenn Edwards

[57] ABSTRACT

A new Concrete Wall Form Aligning Funnel System for funneling concrete from a concrete truck chute into a narrow form wall without spillage. The inventive device includes a tube, a bottom wall is secured to and enclosing an end of the tube, an opening concentrically projects into the bottom wall, a first and second guide member is secured to the bottom wall adjacent the opening for slidably engaging the form wall. The inventive device also includes at least one handle secured to an exterior portion of the tube for allowing the user to manually manipulate the present invention. The guide members slide within the upper portion of the form wall thereby constantly aligning the opening concentrically within the form wall for preventing spillage.

6 Claims, 3 Drawing Sheets

CONCRETE WALL FORM ALIGNING FUNNEL SYSTEM

BACKGROUND OF THE INVENTION

1. Field of the Invention

The present invention relates to Concrete Discharge Chute Devices and more particularly pertains to a new Concrete Wall Form Aligning Funnel System for funneling concrete from a concrete truck chute into a narrow form wall without spillage.

2. Description of the Prior Art

The use of Concrete Discharge Chute Devices is known in the prior art. More specifically, Concrete Discharge Chute Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Concrete Discharge Chute Devices include U.S. Pat. No. 4,572,782; U.S. Design Pat. No. 351,709; U.S. Design Pat. No. 314,270; U.S. Pat. No. 4,190,144; U.S. Pat. No. 4,634,285 and U.S. Pat. No. 4,007,821.

While these devices fulfill their respective, particular objectives and requirements, the aforementioned patents do not disclose a new Concrete Wall Form Aligning Funnel System. The inventive device includes a tube, a bottom wall is secured to and enclosing an end of the tube, an opening concentrically projects into the bottom wall, a first and second guide member is secured to the bottom wall adjacent the opening for slidably engaging the form wall.

In these respects, the Concrete Wall Form Aligning Funnel System according to the present invention substantially departs from the conventional concepts and designs of the prior art, and in so doing provides an apparatus primarily developed for the purpose of funneling concrete from a concrete truck chute into a narrow form wall without spillage.

SUMMARY OF THE INVENTION

In view of the foregoing disadvantages inherent in the known types of Concrete Discharge Chute Devices now present in the prior art, the present invention provides a new Concrete Wall Form Aligning Funnel System construction wherein the same can be utilized for funneling concrete from a concrete truck chute into a narrow form wall without spillage.

The general purpose of the present invention, which will be described subsequently in greater detail, is to provide a new Concrete Wall Form Aligning Funnel System apparatus and method which has many of the advantages of the Concrete Discharge Chute Devices mentioned heretofore and many novel features that result in a new Concrete Wall Form Aligning Funnel System which is not anticipated, rendered obvious, suggested, or even implied by any of the prior art Concrete Discharge Chute Devices, either alone or in any combination thereof.

To attain this, the present invention generally comprises a tube, a bottom wall is secured to and enclosing an end of the tube, an opening concentrically projects into the bottom wall, a first and second guide member is secured to the bottom wall adjacent the opening for slidably engaging the form wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Concrete Wall Form Aligning Funnel System apparatus and method which has many of the advantages of the Concrete Discharge Chute Devices mentioned heretofore and many novel features that result in a new Concrete Wall Form Aligning Funnel System which is not anticipated, rendered obvious, suggested, or even implied by any of the prior art Concrete Discharge Chute Devices, either alone or in any combination thereof.

It is another object of the present invention to provide a new Concrete Wall Form Aligning Funnel System which may be easily and efficiently manufactured and marketed.

It is a further object of the present invention to provide a new Concrete Wall Form Aligning Funnel System which is of a durable and reliable construction.

An even further object of the present invention is to provide a new Concrete Wall Form Aligning Funnel System which is susceptible of a low cost of manufacture with regard to both materials and labor, and which accordingly is then susceptible of low prices of sale to the consuming public, thereby making such Concrete Wall Form Aligning Funnel System economically available to the buying public.

Still yet another object of the present invention is to provide a new Concrete Wall Form Aligning Funnel System which provides in the apparatuses and methods of the prior art some of the advantages thereof, while simultaneously overcoming some of the disadvantages normally associated therewith.

Still another object of the present invention is to provide a new Concrete Wall Form Aligning Funnel System for funneling concrete from a concrete truck chute into a narrow form wall without spillage.

Yet another object of the present invention is to provide a new Concrete Wall Form Aligning Funnel System which includes a tube, a bottom wall is secured to and enclosing an end of the tube, an opening concentrically projects into the bottom wall, a first and second guide member is secured to the bottom wall adjacent the opening for slidably engaging the form wall.

Still yet another object of the present invention is to provide a new Concrete Wall Form Aligning Funnel System that requires only one person to fill a form wall with concrete.

Even still another object of the present invention is to provide a new Concrete Wall Form Aligning Funnel System that efficiently fills the formed wall without spillage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
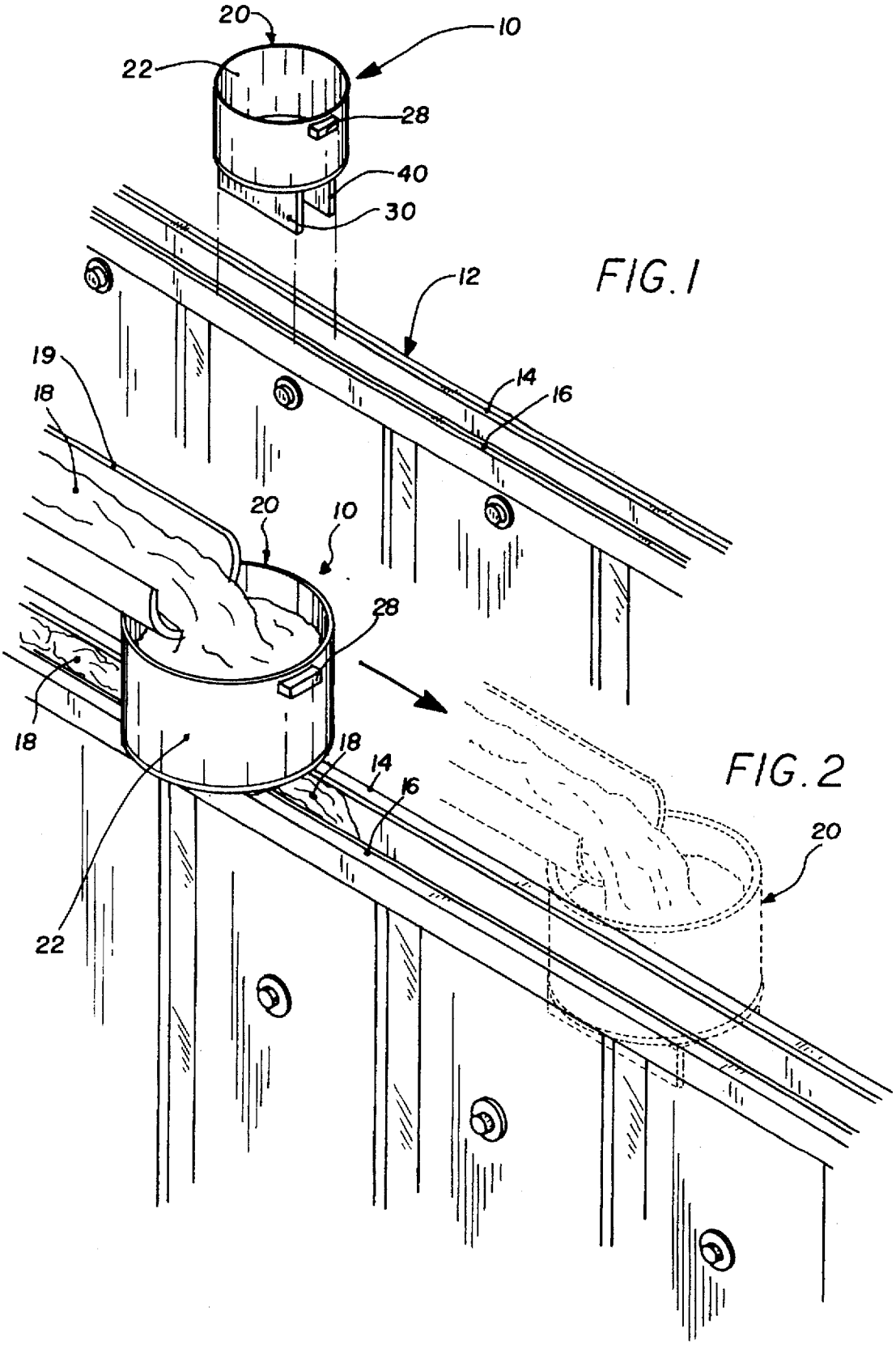
FIG. 1 is an upper perspective view of a new Concrete Wall Form Aligning Funnel System according to the present invention.
FIG. 2 is an upper perspective view of the present invention in slidable interaction with the form wall.

With reference now to the drawings, and in particular to FIGS. 1 through 6 thereof, a new Concrete Wall Form Aligning Funnel System embodying the principles and concepts of the present invention and generally designated by the reference numeral 10 will be described.

Figure 3:
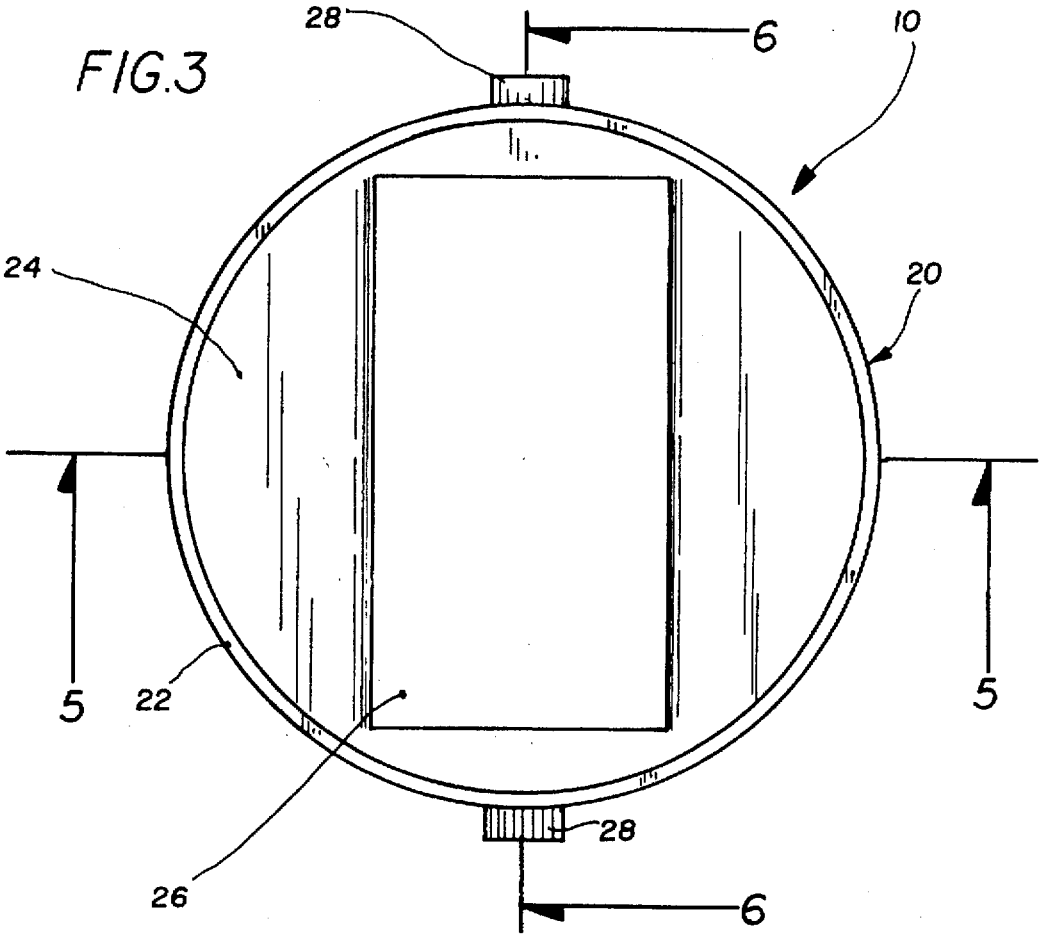
FIG. 3 is a top view of the present invention.
Figure 4:
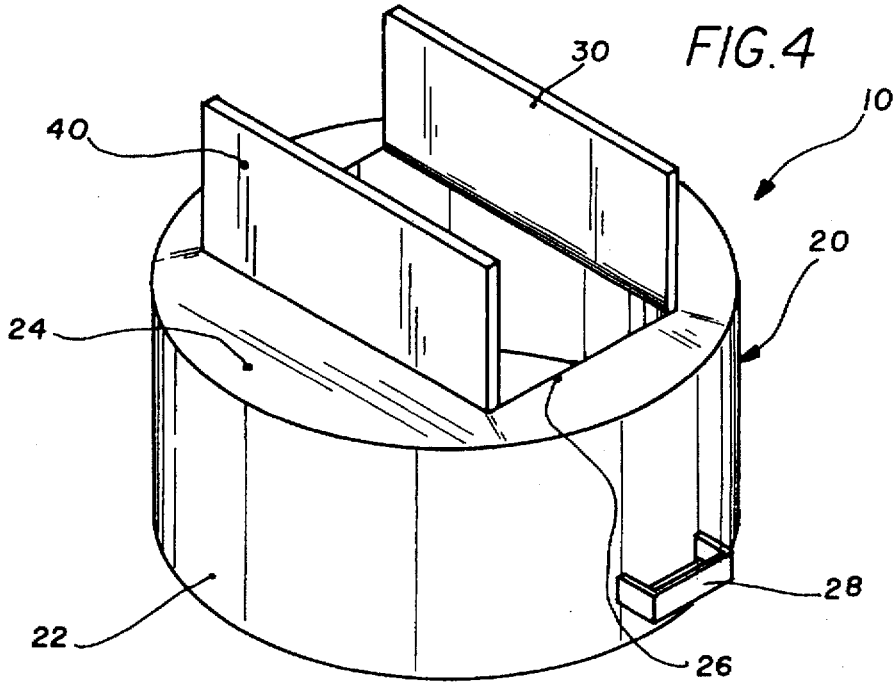
FIG. 4 is an upper perspective view of the present invention inverted.
Figure 5:
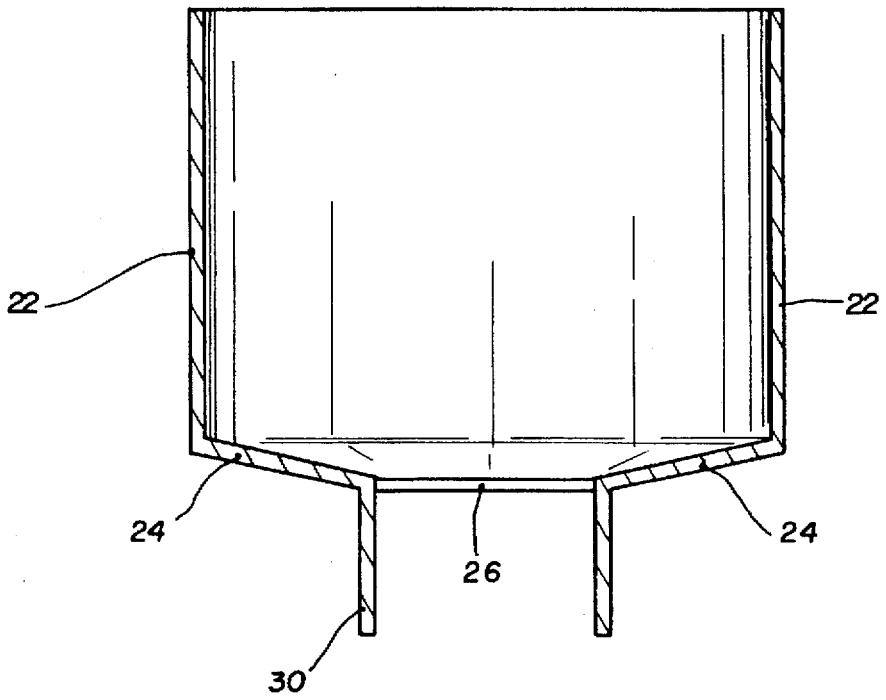
FIG. 5 is a cross sectional view taken along line 5—5 of FIG. 3.
Figure 6:
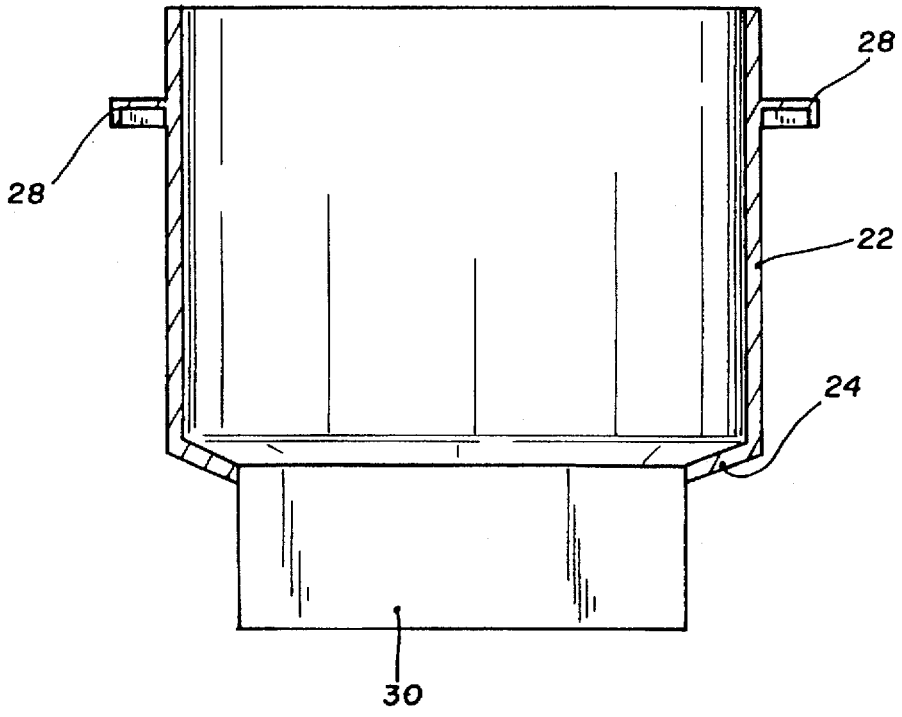
FIG. 6 is a cross sectional view taken along line 6—6 of FIG. 3.

More specifically, it will be noted that the Concrete Wall Form Aligning Funnel System 10 comprises a funnel means 20 for slidably engaging an inner portion of an upper edge of a form wall 12 and for funneling concrete 18 into the form wall 12 from a cement truck chute 19 without spillage around the form wall 12. The funnel means 20 preferably is comprised of a non-corrosive material to prevent deterioration of the present invention in a corrosive environment. The funnel means 20 comprises a tube 22 having a first end, a second end and a longitudinal axis as shown in FIGS. 1 through 6 of the drawings. The tube 22 preferably has a circular cross sectional area as shown in FIGS. 1 through 6 of the drawings. The first end is open for receiving the concrete 18 from the cement truck chute 19 as shown in FIG. 2 of the drawings. A bottom wall 24 is secured to the second end thereby enclosing the second end as shown in FIGS. 3 and 4 of the drawings. The bottom wall 24 is preferably slanted downwardly toward the opening 26 for preventing accumulation of the concrete 18 within the tube 22 as best shown in FIGS. 5 and 6 of the drawings. The bottom wall 24 slidably engages the form wall 12 thereby supporting the tube 22 and the concrete 18 within the tube 22 as shown in FIG. 2 of the drawings. An opening 26 projects concentrically through the bottom wall 24 for allowing the concrete 18 entering the first end to flow into the form wall 12 as best shown in FIGS. 3 through 6 of the drawings. The opening 26 is preferably rectangular shaped allowing the maximum flow of the concrete 18 into the form wall 12. A first guide member 30 is secured to the bottom wall 24 extending away from the tube 22 substantially parallel to the longitudinal axis as shown in FIG. 4 of the drawings. The first guide member 30 is secured adjacent to the opening 26. The first guide member 30 slidably engages a first wall 14 of the form wall 12 for concentrically aligning the opening 26 within the form wall 12 as shown in FIGS. 1 and 2 of the drawings. A second guide member 40 is secured to the bottom wall 24 extending away from the tube 22 substantially parallel to the longitudinal axis and substantially parallel to the first guide member 30 as shown in FIG. 4 of the drawings. The second guide member 40 is secured adjacent to the opening 26 opposite of the first guide member 30. The second guide member 40 slidably engages a second wall 16 of the form wall 12 for concentrically aligning the opening 26 within the form wall 12 as best shown in FIGS. 1 and 2 of the drawings. As shown in FIGS. 4 through 6 of the drawings, the first guide member 30 and the second guide member 40 are preferably formed into a swaged rectangular shape for guiding the concrete 18 into the form wall 12 and for slidably engaging the first wall 14 and the second wall 16 of the form wall 12. As shown in FIGS. 1 through 4 of the drawings, at least one handle 28 is secured to an exterior surface of the tube 22 for allowing manual manipulation of the present invention during utilization.

In an alternative embodiment, the tube 22 is secured to cement truck chute 19 by an unnumbered fastening strap which removably engages the cement truck chute 19. The alternative embodiment allows the user to simply position the funnel means 20 into the proper position along the form wall 12 while continuously allowing the concrete 18 to flow from the cement truck chute 19.

In use, the user positions the first and second guide members 30, 40 of the present invention mesial the first wall 14 and the second wall 16 of a selected portion of the form wall 12. The user aligns the cement truck chute 19 for pouring the concrete 18 into the first end of the tube 22. The concrete 18 is allowed to flow through the cement truck chute 19 into the tube 22 wherein the concrete 18 is guided through the opening 26 into the bottom wall 24. The concrete 18 thereafter flows concentrically into the form wall 12 until the desired amount of concrete 18 is poured within the selected portion of the form wall 12. As shown in FIG. 2 of the drawings, the user manually manipulates the funnel means 20 by sliding the funnel means 20 within the upper portion of the form wall 12 to the next selected portion of the form wall 12 to be filled with the concrete 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A concrete wall form funnel system for funneling concrete from a concrete delivery chute into a concrete form assembly having a pair of spaced parallel vertical form walls each having upper edges, said system comprising:

a funnel means for slidably engaging the upper edges of a pair of spaced form walls, said funnel means comprising a substantially cylindrical concrete hopper having an open upper end for receiving concrete from a concrete delivery chute, a bottom wall mounted at the lower end of said hopper, said bottom wall having a substantially rectangular opening therein, said bottom wall slanting downwardly and radially inward toward said bottom opening, first and second guide members mounted on said bottom wall for guiding said funnel means along a concrete form, said guide members extending downwardly in a spaced relationship for inserting between the upper edges of the spaced form walls of a concrete form to resist lateral movement of said funnel means from concrete form when said funnel means is moved along said upper edges, said guide members being mounted on opposite sides of said bottom opening for aligning said bottom opening with the space between said spaced form walls, and said rectangular bottom opening extending across substantially the entire bottom wall of said concrete hopper to permit maximum flow of concrete through said funnel means into said concrete form;

wherein said first guide member and said second guide member each comprise a substantially rectangular guide plate in a parallel relationship with the other said guide plate, the space between said guide plates and the ends of said guide plates being open so as not to impede concrete flow into said concrete form.

2. The concrete wall form funnel system of claim 1 additionally including at least one handle secured to an exterior surface of said concrete hopper for manual movement of said funnel means.

3. The concrete wall form funnel of claim 1 wherein said funnel means is comprised of a non-corrosive material.

4. A concrete wall form funnel system for funneling concrete from a concrete delivery chute into a concrete form assembly having a pair of spaced parallel vertical form walls each having upper edges, said system comprising:

a funnel means for slidably engaging the upper edges of a pair of spaced form walls, said funnel means comprising a substantially cylindrical concrete hopper having an open upper end for receiving concrete from a concrete delivery chute, a bottom wall mounted at the lower end of said hopper, said bottom wall having a substantially rectangular opening therein, said bottom wall slanting downwardly and radially inward toward said bottom opening.

first and second guide members mounted on said bottom wall for guiding said funnel means along a concrete form, said guide members extending downwardly in a spaced relationship for inserting between the upper edges of the spaced form walls of a concrete form to resist lateral movement of said funnel means from concrete form when said funnel means is moved along said upper edges, said guide members being mounted on opposite sides of said bottom opening for aligning said bottom opening with the space between said spaced form walls, and said rectangular bottom opening extending across substantially the entire bottom wall of said concrete hopper to permit maximum flow of concrete through said funnel means into said concrete form; and two handles secured to an exterior surface of said concrete hopper, said handles being mounted at opposite sides of the concrete hopper;

wherein said funnel means comprises a non-corrosive material; and wherein said first guide member and said second guide member each comprise a substantially rectangular guide plate in a parallel relationship with the other said guide plate, the space between said guide plates and the ends of said guide plates being open so as not to impede concrete flow into said concrete form.

5. A method of distributing concrete from a concrete delivery chute into a concrete form assembly having a pair of spaced parallel vertical form walls each having upper edges, said method comprising:

i) providing a funnel means comprising a substantially cylindrical concrete hopper having an open upper end for receiving concrete from a concrete delivery chute, a bottom wall mounted at the lower end of said hopper, said bottom wall having a substantially rectangular opening therein, said bottom wall slanting downwardly and radially inward toward said bottom opening, first and second guide members mounted on said bottom wall, said guide members extending downwardly in a spaced relationship, and said guide members being mounted on opposite sides of said bottom opening, and said rectangular bottom opening extending across substantially the entire bottom wall of said concrete hopper;

ii) resting said funnel means on the concrete form with the bottom wall resting on the upper edges of the form walls and with the guide members extending between the spaced form walls;

iii) placing concrete into said concrete hopper so that said concrete flows through said bottom opening between said guide members and into said concrete form; and iv) sliding said funnel means along the upper edges of said concrete form as said concrete form fills with concrete below said concrete hopper.

6. The method of claim 5 including the steps of locating a concrete delivery chute above said concrete hopper to deliver a continuous flow of concrete into said concrete hopper, and moving the end of said delivery chute with said concrete hopper as said funnel means is slid along said concrete form.

* * * * *